US010907451B2

(12) United States Patent
Coffin et al.

(10) Patent No.: US 10,907,451 B2
(45) Date of Patent: Feb. 2, 2021

(54) ALTERNATE FLOW PATHS FOR SINGLE TRIP MULTI-ZONE SYSTEMS

(71) Applicant: HALLIBURTON ENERGY SERVICES, INC., Houston, TX (US)

(72) Inventors: Maxime Philippe Coffin, London (GB); Patrick Patchi Bourgneuf, Pau (FR); Andrew David Penno, London (GB)

(73) Assignee: Halliburton Energy Services, Inc., Houston, TX (US)

( * ) Notice: Subject to any disclaimer, the term of this patent is extended or adjusted under 35 U.S.C. 154(b) by 214 days.

(21) Appl. No.: 16/072,860

(22) PCT Filed: Mar. 11, 2016

(86) PCT No.: PCT/US2016/022134
§ 371 (c)(1),
(2) Date: Jul. 25, 2018

(87) PCT Pub. No.: WO2017/155546
PCT Pub. Date: Sep. 14, 2017

(65) Prior Publication Data

US 2018/0371878 A1 Dec. 27, 2018

(51) Int. Cl.
*E21B 43/08* (2006.01)
*E21B 43/04* (2006.01)
(Continued)

(52) U.S. Cl.
CPC ..... *E21B 43/04* (2013.01); *E21B 17/042* (2013.01); *E21B 43/08* (2013.01); *E21B 43/082* (2013.01);
(Continued)

(58) Field of Classification Search
CPC ..... E21B 43/04; E21B 17/042; E21B 43/082; E21B 43/14; E21B 33/1246; E21B 43/26;
(Continued)

(56) References Cited

U.S. PATENT DOCUMENTS 5,476,143 A 12/1995 Sparlin et al.
5,515,915 A 5/1996 Jones et al.
(Continued)

FOREIGN PATENT DOCUMENTS

WO 2015199645 12/2015

OTHER PUBLICATIONS

Singapore Search Report dated Dec. 10, 2019, Singapore Patent Application No. 11201804838Q.
(Continued)

*Primary Examiner* — Yong-Suk (Philip) Ro
(74) *Attorney, Agent, or Firm* — McGuireWoods LLP

(57) ABSTRACT

A single trip multi-zone completion system includes a plurality of completion sections operatively coupled together and extendable within a wellbore. Each completion section includes a base pipe providing an interior and defining one or more perforations at a single axial location to provide fluid communication between the interior and an annulus defined between the completion section and a wellbore wall. One or more sand screens are radially offset from the base pipe such that a flow annulus is defined therebetween, and a production sleeve is movably arranged within the interior of the base pipe between a closed position, where the production sleeve occludes the one or more perforations, and an open position, where the one or more perforations are exposed. A shunt system is positioned about the base pipe to receive and redirect a gravel slurry flowing in the annulus, and thereby provide an alternate flow path for the gravel slurry.

20 Claims, 4 Drawing Sheets

(51) Int. Cl.

| | |
|---|---|
| ***E21B 17/042*** | (2006.01) |
| ***E21B 43/14*** | (2006.01) |
| *E21B 33/124* | (2006.01) |
| *E21B 43/26* | (2006.01) |

(52) U.S. Cl.
CPC ..... *E21B 43/14* (2013.01); *E21B 33/1246* (2013.01); *E21B 43/26* (2013.01)

(58) Field of Classification Search
CPC ..... E21B 43/12; E21B 34/06; E21B 34/063; E21B 43/08; E21B 43/045; E21B 43/267; E21B 34/103; E21B 34/14
See application file for complete search history.

(56) References Cited

U.S. PATENT DOCUMENTS

| | | | | |
|---|---|---|---|---|
| 5,890,533 | A | 4/1999 | Jones | |
| 2002/0053439 | A1 | 5/2002 | Danos | |
| 2003/0141061 | A1* | 7/2003 | Hailey, Jr. ..... | E21B 34/063 166/278 |
| 2009/0133874 | A1 | 5/2009 | Dale et al. | |
| 2010/0314109 | A1 | 12/2010 | Garcia et al. | |
| 2010/0314124 | A1 | 12/2010 | Simancas et al. | |
| 2011/0162840 | A1 | 7/2011 | Haeberle et al. | |
| 2013/0000899 | A1 | 1/2013 | Broussard et al. | |
| 2014/0251609 | A1 | 9/2014 | Broussard et al. | |
| 2015/0041130 | A1 | 2/2015 | Cleveland et al. | |
| 2015/0308238 | A1 | 10/2015 | Langlais | |

OTHER PUBLICATIONS

International Search Report and Written Opinion from PCT/US2016/022134, dated Nov. 25, 2016, 17 pages.
Great Britain Examination Report dated Nov. 4, 2020, Great Britain Application No. GB1810234.3.

* cited by examiner

ALTERNATE FLOW PATHS FOR SINGLE TRIP MULTI-ZONE SYSTEMS

BACKGROUND

In producing hydrocarbons from subterranean formations, it is not uncommon to produce large volumes of particulate material (e.g., sand) along with the formation fluids. The production of sand must be controlled or it may adversely affect the economic life of the well. One of the most commonly used techniques for sand control is known as "gravel packing."

In a typical gravel pack completion, well screens are positioned within the wellbore adjacent an interval to be completed and a gravel slurry is pumped down the well and into the annulus defined between the screens and the wellbore wall. The gravel slurry generally comprises relatively coarse sand or gravel suspended within water or a gel and acts as a filter to reduce the amount of fine formation sand reaching the well screens. As liquid is lost from the slurry into the formation and/or through the screens, the gravel from the slurry is deposited around the screens to form a permeable mass around the screen which allows produced fluids to flow through the gravel mass while substantially blocking the flow of particulates.

One common problem in gravel packing operations, especially where long or inclined intervals are to be completed, is adequately distributing the gravel over the entire completion interval, and thereby completely packing the annulus along the length of the screens. Poor distribution of gravel (i.e., voids in the gravel pack) is often caused when liquid from the gravel slurry is lost prematurely into the more permeable portions of the formation, thereby resulting in "sand bridges" forming in the annulus before all of the gravel has been properly deposited. These sand bridges effectively block further flow of the gravel slurry within the annulus and prevent delivery of gravel to all parts of the annulus surrounding the screens.

One approach to avoiding the creation of annulus sand bridges has been to incorporate shunt tubes that longitudinally extend across the sand screens. The shunt tubes provide flow paths that allow the inflowing gravel slurry to bypass any sand bridges that may be formed and otherwise permit the gravel slurry to enter the annulus between the sand screens and the wellbore beneath sand bridges, thereby forming the desired gravel pack beneath it.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
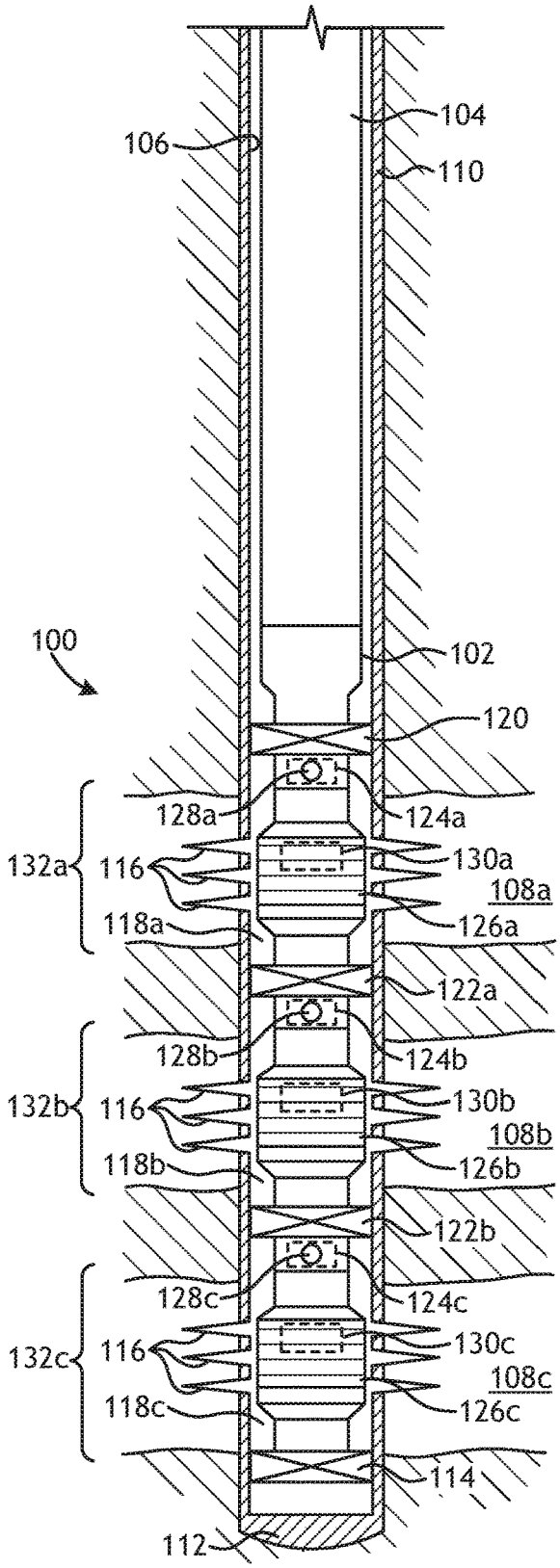
FIG. 1 depicts an exemplary single trip multi-zone completion system that can incorporate principles of the present disclosure.

The present disclosure generally relates to downhole fluid flow control and, more particularly, to shunt systems used to distribute a gravel slurry in single trip multi-zone completion systems.

The presently disclosed embodiments facilitate a more complete or enhanced sand face pack during gravel packing and/or formation fracture packing operations in conjunction with single trip multi-zone completion systems. The single trip multi-zone completion systems include a plurality of completion sections operatively coupled together and extendable within a wellbore. Each completion section includes a base pipe providing an interior and defining one or more perforations at a single axial location to provide fluid communication between the interior and an annulus defined between the completion section and a wellbore wall. One or more sand screens are radially offset from the base pipe such that a flow annulus is defined therebetween, and a production sleeve is movably arranged within the interior of the base pipe between a closed position, where the production sleeve occludes the one or more perforations, and an open position, where the one or more perforations are exposed. A shunt system is positioned about the base pipe to receive and redirect a gravel slurry flowing in the annulus. The shunt system may prove advantageous in redirecting the gravel slurry around sand bridges that may form in the annulus, for example, and thereby resulting in a more complete sand face pack.

In producing oil and gas from subterranean formations, extended reach wells can now extend as much as 31,000 feet or more below the ground or subsea surface. Offshore wells, for example, may be drilled in water exhibiting depths of as much as 10,000 feet or more, and the total depth from an offshore drilling vessel to the bottom of a drilled wellbore can be in excess of six miles. Such extraordinary distances in modern well construction can cause significant challenges in equipment, drilling, and servicing operations. It may take many days, for example, for a wellbore service tool string to make a "trip" to the bottom of a wellbore, due in part to the time consuming practice of making and breaking pipe joints to reach the desired depth. The time required to assemble and deploy any service tool assembly downhole for such a long distance is very time consuming and costly.

To enable the fracturing and/or gravel packing of multiple hydrocarbon-producing zones in extended reach wells in reduced timelines, wellbore service providers have developed "single trip" multi-zone wellbore systems. Single trip multi-zone completion technology enables operators to run a completion string including all of the required screens and packers at one time, and then subsequently use a single service tool to sequentially fracture and/or gravel pack the various wellbore intervals defined by the completion string in a single trip. As can be appreciated, this technology can minimize the number of trips into the wellbore and rig days required to complete wellbores having multiple pay zones.

FIG. 1 depicts an exemplary single trip multi-zone completion system 100 that can incorporate principles of the present disclosure, according to one or more embodiments.

The single trip multi-zone completion system 100 (hereafter the "system 100") and associated methods of its use may include components, procedures, etc. that are similar to those used in the ESTMZ™ completion system marketed by Halliburton Energy Services, Inc. of Houston, Tex., USA. It will be appreciated, however, that the principles of the present disclosure may be equally applied to other types and configurations of single trip multi-zone completion systems and technology, without departing from the scope of the disclosure.

As illustrated, the system 100 may include an outer completion string 102 that may be extended into a wellbore 106 as coupled to a work string 104. Even though FIG. 1 depicts the system 100 as being arranged in a vertical section of the wellbore 106, those skilled in the art will readily recognize that the principles of the present disclosure are equally well suited for use in horizontal, deviated, slanted, or uphill wellbores. Moreover, the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

The wellbore 106 may penetrate multiple formation zones 108*a*, 108*b*, and 108*c*, and the outer completion string 102 may be advanced in the wellbore 106 until being positioned generally adjacent the formation zones 108*a-c*. In some cases, the formation zones 108*a-c* may comprise portions of a common subterranean formation or hydrocarbon-bearing reservoir. Alternatively, one or more of the formation zones 108*a-c* may comprise portion(s) of separate subterranean formations or hydrocarbon-bearing reservoirs. Although only three formation zones 108*a-c* are depicted in FIG. 1, it will be appreciated that any number of formation zones 108*a-c* (including one) may be treated or otherwise serviced using the system 100. Moreover, the term "zone" as used herein, is not limited to one type of rock formation, but may include several types.

In some embodiments, as depicted in FIG. 1, the wellbore 106 may be lined with a string of casing 110 and properly cemented therein, as known in the art. In such embodiments, a cement plug 112 may be formed at the bottom of the casing 110. In other embodiments, however, the casing 110 and cement may be omitted and the system 100 may alternatively be deployed for operation in an open-hole section of the wellbore 106, without departing from the scope of the disclosure. In yet other embodiments, the system 100 may be deployed for operation in a wellbore 106 partially lined with casing 110 while other portions remain open-hole portions. In such embodiments, some of the formation zones 108*a-c* may be cased, while others are open-hole. Accordingly, use of the casing 110 is for illustrative purposes in describing operation and components of the system 100, but should not be considered limiting to the present disclosure. As discussed herein below, the outer completion string 102 may be deployed or otherwise set within the wellbore 106 in a single trip and used to hydraulically fracture ("frack") and/or gravel pack the various production intervals of the formation zones 108*a-c*.

Prior to deploying the system 100 in the wellbore 106, a sump packer 114 may be lowered into the wellbore 106 and set by wireline at a predetermined location below the formation zones 108*a-c*. In embodiments where the wellbore 106 includes the casing 110, one or more perforations 116 may then be formed in the casing 110 at each formation zone 108*a-c*. The perforations 116 may provide fluid communication between each respective formation zone 108*a-c* and the annulus formed between the outer completion string 102 and the casing 110. In particular, a first annulus 118*a* may be generally defined between the first formation zone 108*c* and the outer completion string 102. Second and third annuli 118*b* and 118*c* may similarly be defined between the second and third formation zones 108*b* and 108*c*, respectively, and the outer completion string 102.

The outer completion string 102 may include a top packer 120 including slips (not shown) configured to support the outer completion string 102 within the casing 110 when properly deployed adjacent the production intervals. In some embodiments, the top packer 120 may be a VERSA-TRIEVE® packer commercially available from Halliburton Energy Services, Inc. of Houston, Tex., USA. Disposed below the top packer 120 may be one or more isolation packers 122 (two shown), one or more circulating sleeves 124 (three shown in dashed), and one or more sand screens 126 (three shown).

Specifically, arranged below the top packer 120 may be a first circulating sleeve 124*a* (shown in dashed) and a first sand screen 126*a*. A first isolation packer 122*a* may be disposed below the first sand screen 126*a*, and a second circulating sleeve 124*b* (shown in dashed) and a second sand screen 126*b* may be disposed below the first isolation packer 122*a*. A second isolation packer 122*b* may be disposed below the second sand screen 126*b*, and a third circulating sleeve 124*c* (shown in dashed) and a third sand screen 126*c* may be disposed below the second isolation packer 122*b*. The top packer 120 and the first isolation packer 122*a* may effectively isolate the first zone 108*a*, the first and second isolation packers 122*a,b* may effectively isolate the second zone 108*b*, and the second isolation packer 122*b* and the sump packer 114 may effectively isolate the third zone 108*c*. Those skilled in the art will readily recognize, however, that additional isolation packers 122, circulating sleeves 124, and sand screens 126 may be employed in the outer completion string 102, without departing from the disclosure, and depending on the length and number of production intervals desired.

Each circulating sleeve 124*a-c* may be movably arranged within the outer completion string 102 and configured to axially translate between open and closed positions. First, second, and third ports 128*a*, 128*b*, and 128*c* may be defined in the outer completion string 102 at the first, second, and third circulating sleeves 124*a-c*, respectively. When the circulating sleeves 124*a-c* are moved into their respective open positions, the ports 128*a-c* are opened and may thereafter allow fluids to be introduced into the corresponding annuli 118*a-c* via the interior of the outer completion string 102.

The sand screens 126 may each comprise fluid-porous, particulate restricting devices made from a plurality of layers of a wire mesh that are diffusion bonded or sintered together to form a fluid porous wire mesh screen. In other embodiments, however, the sand screens 126 may have multiple layers of a woven wire metal mesh material having a uniform pore structure and a controlled pore size that is determined based upon the properties of the surrounding formation. For example, suitable woven wire mesh screens may include, but are not limited to, a plain Dutch weave, a twilled Dutch weave, a reverse Dutch weave, combinations thereof, or the like. In other embodiments, however, the sand screens 126 may include a single layer of wire mesh, multiple layers of wire mesh that are not bonded together, a single layer of wire wrap, multiple layers of wire wrap or the like, that may or may not operate with a drainage layer. Those skilled in the art will readily recognize that several other sand screen 120 designs are equally suitable. While only one sand screen 126 is depicted in each formation zone 108*a-c*, it will be appreciated that multiple sand screens 126 may alternatively be axially aligned along the outer completion string 102 within each formation zone 108*a-c*, without departing from the scope of the disclosure.

Each sand screen 126*a-c* may include a corresponding production sleeve 130*a*, 130*b*, and 130*c* (shown in dashed) movably arranged within a non-perforated base pipe (not shown) and axially translatable between open and closed positions. More particularly, each production sleeve 130*a-c* may be moved to allow fluids to be introduced into the outer completion string 102 from the corresponding formation zones 108*a-c* via the corresponding sand screens 126*a-c*. In the closed position, the production sleeves 130*a-c* may prevent fluid flow into the outer completion string 102, but moving the production sleeves 130*a-c* may expose corresponding perforations (not shown) and thereby allow fluids to enter the interior of the outer completion string 102 via the sand screens 126*a-c*. Accordingly, the sand screens 126*a-c* may be characterized as and otherwise referred to herein as modular screens. A modular screen, for example, typically constitutes an assembly of sand screens that includes an annular flow annulus or flow path that fluidly communicates with the interior of the underlying base pipe, and an associated production sleeve 130*a-c* selectively regulates (allows) fluid communication into the base pipe.

Accordingly, the outer completion string 102 may be made up of multiple completion sections 132, shown as completion sections 132*a*, 132*b*, and 132*c*, where each completion section 132*a-c* includes one or more sand screens 126*a-c* that are situated between upper and lower packers 120, 122*a,b*, and 114. While not shown, the outer completion string 102 may further include additional completion sections downhole from the completion sections 132*a-c*. In order to deploy the outer completion string 102 within the wellbore 106, the completion sections 132*a-c* may first be assembled at the surface starting from the bottom up and suspended in the wellbore 106. The outer completion string 102 may then be lowered into the wellbore 102 on the work string 104, which is generally made up to the top packer 120. In some embodiments, the outer completion string 102 is lowered into the wellbore 106 until engaging the sump packer 114. In other embodiments, the outer completion string 102 may be lowered into the wellbore 106 and stung into the sump packer 114. In yet other embodiments, the sump packer 114 is omitted from the system 100 and the outer completion string 102 may instead be blanked off at its bottom end so that there is no inadvertent production directly into the outer completion string 102 without first passing through at least the third sand screen 126*c*.

Upon aligning each completion section 132*a-c* with the corresponding production zones 108*a-c*, the top packer 120 may be set and serves to suspend the outer completion string 102 within the wellbore 106. The isolation packers 122*a,b* may also be set at this time, thereby axially defining each annulus 118*a-c* and further defining the individual production intervals corresponding to the various formation zones 108*a-c*. The work string 104 may then be detached from the outer completion string 102 and retrieved to the surface.

An inner service tool (not shown), also known as a gravel pack service tool, may form part of the work string 104 and may then be lowered into the outer completion string 102. The inner service tool may then be sequentially and progressively operated within each completion section 132*a-c* to fracture and/or gravel pack each production interval corresponding to the formation zones 108*a-c*. In one embodiment, for instance, the inner service tool may be first positioned and operated in the third completion section 132*c*, then moved upward for operation in the second completion section 132*b*, and lastly moved upward for operation in the first completion section 132*a*. It will be appreciated, however, that the inner service tool may treat the formation zones 108*a-c* in any desired order.

In some embodiments, the inner service tool may include one or more shifting tools (not shown) used to open and/or close the circulating sleeves 124*a-c* and the production sleeves 130*a-c*. In such embodiments, the inner service tool may include two shifting tools; a first shifting tool used to open the circulating sleeves 124*a-c* and the production sleeves 130*a-c*, and a second shifting tool used to close the circulating sleeves 124*a-c* and production sleeves 130*a-c*. In other embodiments, more or less than two shifting tools may be used, without departing from the scope of the disclosure. In yet other embodiments, the shifting tools may be omitted and the circulating sleeves 124*a-c* and production sleeves 130*a-c* may instead be remotely actuated, such as through the use of actuators, solenoids, pistons, and the like.

Before producing hydrocarbons from the various formation zones 108*a-c* penetrated by the outer completion string 102, each formation zone 108*a-c* may be hydraulically fractured in order to enhance hydrocarbon production, and each annulus 118*a-c* may also be gravel packed to ensure limited sand production into the outer completion string 102 during production. As indicated above, the fracturing and gravel packing processes for the outer completion string 102 may be accomplished sequentially or otherwise in step-wise fashion for each individual formation zone 108*a-c*, for example, starting from the bottom of the outer completion string 102 and proceeding in an uphole direction (i.e., toward the surface of the well).

In one embodiment, the third production interval or formation zone 108*c* may be fractured and the third annulus 118*c* may be gravel packed prior to proceeding sequentially to the second and first completion sections 132*a,b*. To accomplish this, the third circulating sleeve 124*c* and the third production sleeve 130*c* may be moved to their corresponding open positions, and a gravel slurry may then be pumped down the work string and into the inner service tool. The gravel slurry may include, but is not limited to, a carrier liquid and particulate material such as gravel or proppant. In some cases, a viscosifying agent and/or one or more additives may be added to the carrier fluid.

The incoming gravel slurry may be discharged into the third annulus 118*c* via the third port 128*c*. Continued pumping of the gravel slurry forces the gravel slurry into the third formation zone 108*c* through the perforations 116 in the casing string 110, thereby creating, enhancing, and extending a fracture network therein while the accompanying proppant serves to support and maintain the fracture network in an open configuration. The gravel slurry gradually builds in the annulus 118*c* and begins to form a "sand face" pack, which, in conjunction with the third sand screen 126*c*, serves to prevent the influx of sand or other particulates from the third formation zone 108*c* during production operations. In embodiments where the wellbore 106 is an open-hole wellbore, fracturing is generally not required, and the incoming gravel slurry will only gradually build in the annulus 118*c* to form an annular pack.

Once a screen out is achieved in the third formation zone 108*c*, injection of the gravel slurry is stopped and excess proppant remaining in the work string may be reversed out by reverse flowing the gravel slurry. When the proppant is successfully reversed, the third circulating sleeve 124*c* and the third production sleeve 130*c* are closed, and the third annulus 118*c* is then pressure tested to verify that the corresponding circulating sleeve 124*c* and production sleeve 130*c* are properly closed. At this point, the third formation zone 108*c* has been successfully fractured and/or the third annulus 118*c* has been successfully gravel packed.

The inner service tool (i.e., the gravel pack service tool) may then be axially moved within the outer completion string 102 to successively locate the second and first completion sections 132*a,b*, where the foregoing process is repeated in order to treat the first and second formation zones 108*a,b* and gravel pack the first and second annuli 118*a,b*. Once the last zone (first annulus 118*a*) has been treated, the corresponding production sleeve is shifted close and the completion string 102 is pressure tested, the inner service tool may be removed from the outer completion string 102 and the well altogether. Hydrocarbon production operations may then commence.

Figure 2A:
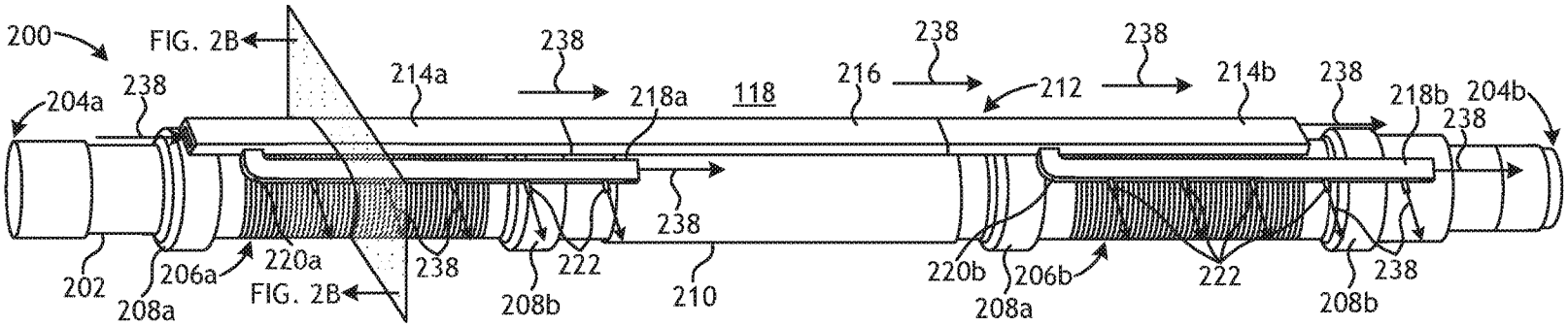
FIG. 2A depicts an exemplary completion section that can incorporate principles of the present disclosure.

FIG. 2A is an isometric view of an exemplary completion section 200, according to one or more embodiments of the present disclosure. More particularly, the completion section 200 shows a lower portion thereof that only depicts the screen section, and otherwise omits the associated isolation packer, circulating sleeve, and one or more blank pipe sections that extend between the circulating sleeve and the screens. For simplicity, the following discussion of the completion section 200 is focused on the depicted screen section, but those skilled in the art will recognize that various component parts of the completion section 200 are not shown. The completion section 200 may be the same as or similar to any of the completion sections 132*a-c* described above with reference to FIG. 1 and, therefore, may be included in the system 100 along with at least one additional completion section and deployed within the wellbore 106 to undertake fracturing and/or gravel packing operations. As with the completion sections 132*a-c* of FIG. 1, the completion section 200 may be configured to be deployed in cased (i.e., including the casing 110 of FIG. 1) or open-hole sections of the wellbore 106 (FIG. 1).

As illustrated, the screen portion of the completion section 200 may include a base pipe 202 having a first or upper end 204*a* and a second or lower end 204*b*. While not shown, the base pipe 202 may be coupled at the upper and lower ends 204*a,b* to other portions of the system 100. For example, the upper end 204*a* may be operatively coupled to one or more blank pipes (not shown) and a sub (not shown) that includes a circulating sleeve 124*a-c* (FIG. 1) and a corresponding port 128*a-c* (FIG. 1) that facilitates discharge of the gravel slurry into the surrounding annulus 118. Moreover, the lower end 204*b* may be operatively coupled to an additional completion section (not shown) that forms part of a single trip multi-zone completion system (e.g., the system 100 of FIG. 1).

The completion section 200 may include two sand screens 206*a* and 206*b* arranged about the base pipe 202 and axially offset from each other. While two sand screens 206*a,b* are shown in FIG. 2A, it will be appreciated that the completion section 200 may include more or less than two sand screens 206*a,b*, without departing from the scope of the disclosure. The sand screens 206*a,b* may be similar to the sand screens 126*a-c* of FIG. 1 and, therefore, may each comprise a fluid-porous, particulate restricting device made from one or more wires wrapped or meshed about the base pipe 202. Each sand screen 206*a,b* may include and extend axially between an upper end ring 208*a* and a lower end ring 208*b*, and a communication sleeve 210 may extend between the lower end ring 208*b* of the first sand screen 206*a* and the upper end ring 208*a* of the second sand screen 206*b*.

The completion section 200 may further include a shunt system 212 used to ensure a complete sand face pack is achieved in the annulus 118 while gravel packing about the completion section 200. In the illustrated embodiment, the shunt system 212 is positioned on the exterior of the sand screens 206*a,b* and includes a first transport tube 214*a*, a second transport tube 214*b*, a jumper tube 216 that fluidly couples the first and second transport tubes 214*a,b*, a first packing tube 218*a*, and a second packing tube 218*b*. Each of the transport tubes 214*a,b*, the jumper tube 216, and the packing tubes 218*a,b* may comprise tubular conduits configured to transport a gravel slurry, such as a proppant-laden gravel slurry. In some embodiments, as illustrated, each of the transport tubes 214*a,b*, the jumper tube 216, and the packing tubes 218*a,b* may comprise generally rectangular tubes or conduits. In other embodiments, however, one or more of the transport tubes 214*a,b*, the jumper tube 216, and the packing tubes 218*a,b* may exhibit other cross-sectional shapes such as, but not limited to, circular, oval, square, or other polygonal shapes.

The first transport tube 214*a* may be coupled to or otherwise secured near the upper end ring 208*a* of the first sand screen 206*a* and extend axially along all or a portion of the first sand screen 206*a*. The second transport tube 214*b* may similarly extend along all or a portion of the second sand screen 206*b*. The jumper tube 216 operatively couples and facilitates fluid communication between the first and second transport tubes 214*a,b* and generally spans the axial distance over the communication sleeve 210.

The first packing tube 218*a* may be coupled to the first transport tube 214*a* at a first flow junction 220*a* that extends from the first transport tube 214*a*, and the second packing tube 218*b* may be coupled to the second transport tube 214*b* at a second flow junction 220*b* that extends from the second transport tube 214*b*. The first and second flow junctions 220*a,b* may facilitate fluid communication between the first and second transport tubes 214*a,b* and the first and second packing tubes 218*a,b*, respectively, such that a portion of the gravel slurry flowing within the first and second transport tubes 214*a,b* may be transferred to the first and second packing tubes 218*a,b* for discharge into the annulus 118. In the illustrated embodiment, the packing tubes 218*a,b* may extend substantially parallel to the transport tubes 214*a,b*, but may alternatively extend at an angle offset from parallel, without departing from the scope of the disclosure.

In some embodiments, as illustrated, the first and second packing tubes 218*a,b* may include one or more orifices 222 defined in a sidewall of the packing tubes 218*a,b*. In at least one embodiment, as illustrated, the orifices 222 may comprise nozzles that extend from the sidewall of the packing tubes 218*a,b*. The orifices 222 may be configured to discharge the gravel slurry from the packing tubes 218*a,b* into the surrounding annulus 118. In other embodiments, or in addition thereto, the gravel slurry may be discharged from the ends of one or both of the packing tubes 218*a,b*, which may be open to the annulus 118.

In some embodiments, one or more of the transport tubes 214*a,b*, the jumper tube 216, the packing tubes 218*a,b*, and the orifices 222 may be erosion-resistant or otherwise made of an erosion-resistant material. Suitable erosion-resistant materials include, but are not limited to, a carbide (e.g., tungsten, titanium, tantalum, or vanadium), a carbide embedded in a matrix of cobalt or nickel by sintering, a cobalt alloy, a ceramic, a surface hardened metal (e.g., nitrided metals, heat-treated metals, carburized metals, hardened steel, etc.), a steel alloy (e.g. a nickel-chromium alloy, a molybdenum alloy, etc.), a cermet-based material, a metal matrix composite, a nanocrystalline metallic alloy, an amorphous alloy, a hard metallic alloy, or any combination thereof.

In other embodiments, or in addition thereto, one or more of the transport tubes 214*a,b*, the jumper tube 216, the packing tubes 218*a,b*, and the orifices 222 may be made of a metal or other material that is internally clad or coated with an erosion-resistant material such as, such as tungsten carbide, a cobalt alloy, or ceramic. Cladding with the erosion-resistant material may be accomplished via any suitable process including, but not limited to, weld overlay, thermal spraying, laser beam cladding, electron beam cladding, vapor deposition (chemical, physical, etc.), any combination thereof, and the like.

Figure 2B:
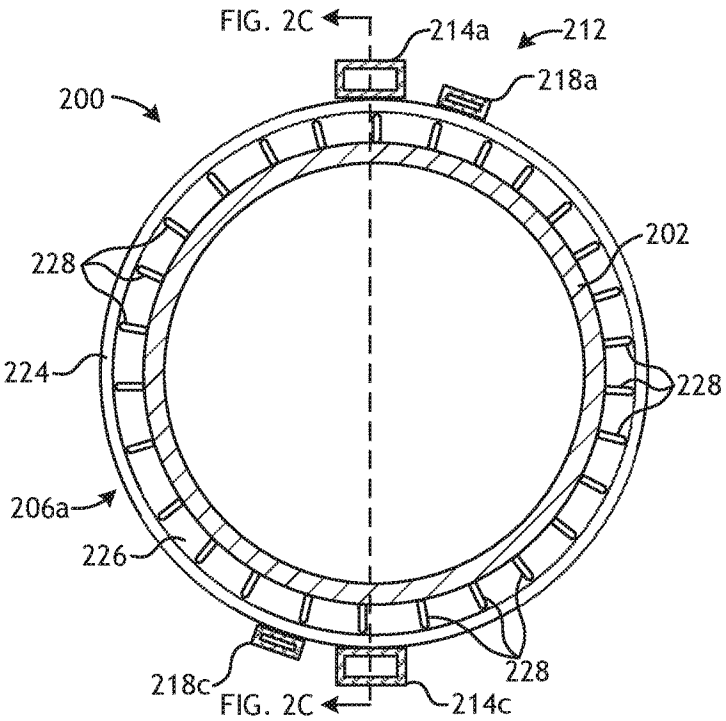
FIG. 2B depicts a cross-sectional end view of the completion section of FIG. 2A as taken at the plane depicted in FIG. 2A.
Figure 2C:
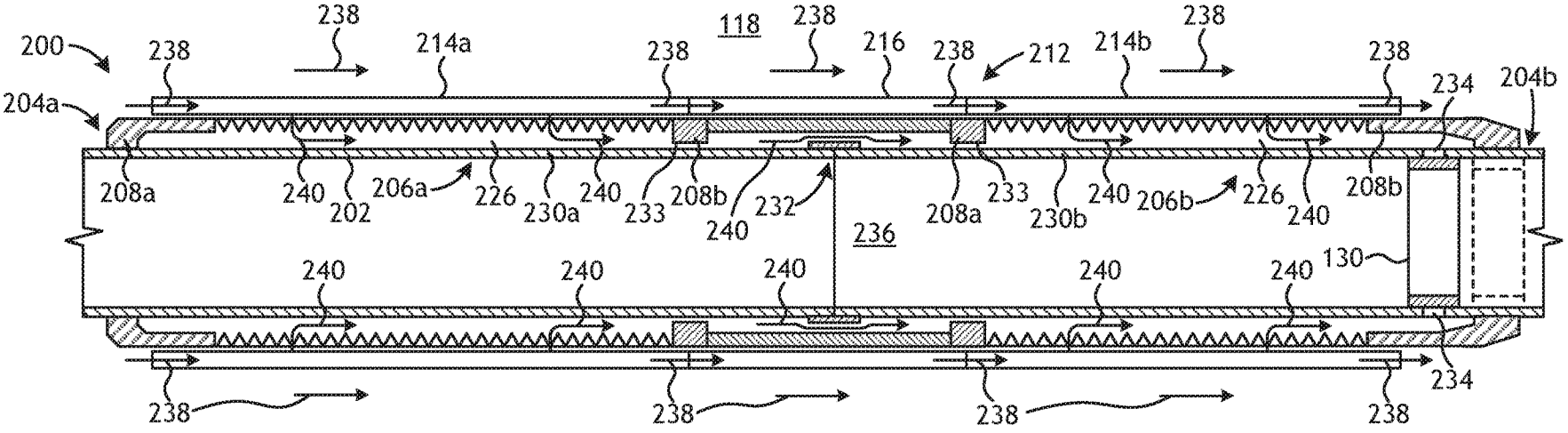
FIG. 2C is a cross-sectional side view of the completion section of FIG. 2A as taken along the lines depicted in FIG. 2B.

FIGS. 2B and 2C depict cross-sectional views of the screen section of the completion section 200. More particularly, FIG. 2B depicts a cross-sectional end view of the completion section 200 as taken at the plane depicted in FIG. 2A, and FIG. 2C is a cross-sectional side view of the completion section 200 as taken along the lines depicted in FIG. 2B.

In FIG. 2B, the first sand screen 206*a* and an upper portion of the shunt system 212 are shown. As illustrated, the first sand screen 206*a* may include at least one wire 224 wrapped about the circumference of the base pipe 202 a plurality of turns (windings) or otherwise forming a mesh. A void or flow gap results between each laterally adjacent turn of the wire 224 through which fluids may penetrate the first sand screen 206*a*. The wire 224 may be radially offset from the base pipe 202, thereby defining a flow annulus 226 between the base pipe 202 and the wire 224. The radial offset is caused by a plurality of ribs 228 extending longitudinally along the outer surface of the base pipe 202. The dimensions of the flow annulus 226 largely depend on the height of the ribs 228. As illustrated, the ribs 228 are angularly spaced from each other about the circumference of the base pipe 202. In some embodiments, as illustrated, the ribs 228 have a generally triangular cross-section, but may alternatively exhibit other cross-sectional geometries including, but not limited to, rectangular and circular cross-sections.

The shunt system 212 is depicted as including the first transport tube 214*a* and the first packing tube 218*a* angularly offset from each other about the periphery of the first sand screen 206*a*. The shunt system 212 may further include another set of transport and packing tubes, shown in FIG. 2B as a third transport tube 214*c* and a third packing tube 218*c*. In the illustrated embodiment, the first transport and packing tubes 214*a*, 218*b* may be positioned diametrically opposite the third transport and packing tubes 214*c*, 218*c* about the circumference of the base pipe 202. In other embodiments, however, the first transport and packing tubes 214*a*, 218*b* may be angularly offset only a short distance from the third transport and packing tubes 214*c*, 218*c* about the circumference of the base pipe 202 in order to minimize the overall outer diameter of the completion section 200. Moreover, while two sets of transport and packing tubes are depicted in FIG. 2B, it will be appreciated that the shunt system 212 may include more than two sets of transport and packing tubes and the multiple sets may be equidistantly or randomly positioned about the circumference of the base pipe 202.

In FIG. 2C, the base pipe 202 is depicted as including an upper base pipe portion 230*a* and a lower base pipe portion 230*b* coupled at a joint 232, such as a threaded joint that threadably couples the upper and lower base pipe portions 230*a,b*. The communication sleeve 210 generally extends across the joint 232 between the lower end ring 208*b* of the first sand screen 206*a* and the upper end ring 208*a* of the second sand screen 206*b*. One or more flow channels 233 may be defined through the lower end ring 208*b* of the first sand screen 206*a* and the upper end ring 208*a* of the second sand screen 206*b* to facilitate fluid communication across the joint 232 and between the sand screens 206*a,b*, and thereby effectively extending the flow annulus 226 across the joint 232 and along the length of the completion section 200.

The upper and lower end rings 208*a,b* provide a mechanical interface between the base pipe 202 and the sand screens 206*a,b*. In some embodiments, for example, the sand screens 206*a,b* may be welded or brazed to the upper and lower end rings 208*a,b*. In other embodiments, the sand screens 206*a,b* may be mechanically fastened to the upper and lower end rings 208*a,b* using, for example, one or more mechanical fasteners (e.g., bolts, pins, rings, screws, etc.) or otherwise secured between the upper and lower end rings 208*a,b* and a structural component of the upper and lower end rings 208*a,b*, such as a communication sleeve or crimp ring. As illustrated, the sand screens 206*a,b* may extend between the upper and lower end rings 208*a,b* along the axial length of the base pipe 202.

The upper and lower end rings 208*a,b* may be formed from a metal, such as 13 chrome, 304L stainless steel, 316L stainless steel, 420 stainless steel, 410 stainless steel, INCOLOY® 825, iron, brass, copper, bronze, tungsten, titanium, cobalt, nickel, combinations thereof, or the like. Moreover, the upper and lower end rings 208*a,b* may be coupled or otherwise attached to the outer surface of base pipe 202 by being welded, brazed, threaded, mechanically fastened, shrink-fitted, or any combination thereof. In other embodiments, however, the upper and lower end rings 208*a,b* may alternatively form an integral part of the sand screens 206*a,b*.

One or more perforations 234 (two shown) may be defined in the base pipe 202 and configured to provide fluid communication between an interior 236 of the base pipe 202 and the surrounding annulus 118. In contrast to other downhole systems requiring the use of a perforated base pipe, which includes multiple perforations distributed along the axial length of a base pipe, the perforations 234 in the completion section 200 are defined at a single axial location along the base pipe 202. Accordingly, influx of fluids into the interior 236 may be facilitated only at one axial location along the base pipe 202, and the fluids must therefore traverse the axial length of the flow annulus 226 until locating the perforations 234 at the single axial location.

A production sleeve 130 similar to the production sleeves 130*a-c* of FIG. 1 may be movably arranged within the interior of the base pipe 202 between open and closed positions. When in the closed position, as illustrated, the production sleeve 130 occludes the perforations 234 and thereby prevents fluid communication between the interior 236 and the surrounding annulus 118 via the sand screens 206*a,b*. In the open position, however, as shown in dashed lines, the production sleeve 130 moves axially within the interior 236 to expose the perforations 234 and thereby allows fluid influx into the interior 236 from the annulus 118 via the sand screens 206*a,b*. Completion sections that are axially adjacent the completion section 200 also include a production sleeve to control fluid communication into a common base pipe 202. While the production sleeve 130 of the depicted completion section 200 is in the open position, the corresponding production sleeves of the adjacent completion sections will be in the closed position, thereby effectively isolating adjacent formation zones 108*a-c* (FIG. 1) during the various operations occurring in the single trip multi-zone completion system 100 (FIG. 1).

As indicated above, the production sleeve 130 may be moved between the open and closed positions using an inner service tool with one or more shifting tools configured to engage and move the production sleeve 130. In other embodiments, the production sleeve 130 may be moved between the open and closed positions using any type of actuator such as, but not limited to, a mechanical actuator, an electric actuator, an electromechanical actuator, a hydraulic actuator, a pneumatic actuator, or any combination thereof. In yet other embodiments, the production sleeve 130 may be moved between closed and open positions by being acted upon by one or more wellbore projectiles, such as wellbore darts or balls. In yet other embodiments, the production sleeve 130 may be triggered to move between closed and open positions by assuming a pressure differential within the interior 236 of the base pipe 202.

Exemplary operation of the completion section 200 is now provided with reference to FIGS. 2A and 2C. A gravel slurry is introduced into the annulus 118, as indicated by the arrows 238, and may generally flow in a downhole direction (i.e., to the right in FIGS. 2A and 2C) within the annulus 118. The gravel slurry 238 may be introduced into the annulus 118, for example, from a sub (not shown) that includes a circulating sleeve 124*a-c* (FIG. 1) and a corresponding port 128*a-c* (FIG. 1) that facilitates discharge of the gravel slurry 238 into the surrounding annulus 118. As mentioned above, the gravel slurry 238 may include, but is not limited to, a carrier liquid and particulate material such as gravel or proppant. In some cases, a viscosifying agent and/or one or more additives may be added to the carrier fluid. The gravel slurry 238 may gradually fill the annulus 118 and, over time, one or more sand bridges or the like may form in the annulus 118, thereby preventing the gravel slurry 238 from proceeding further downhole within the annulus 118. When sand bridges are formed, the shunt system 212 may prove useful in bypassing the sand bridges and otherwise redirecting the gravel slurry 238 to the remaining un-filled portions of the annulus 118.

More particularly, the first transport tube 214*a* is open at its uphole end to receive and convey a portion of the gravel slurry 238 to the second transport tube 214*b* via the jumper tube 216. In some embodiments, the uphole end of the first transport tube 214*a* may be positioned uphole from the first sand screen 206*a* and radially adjacent a blank pipe (not shown) operatively coupled to the upper end 204*a* of the base pipe 202. As the gravel slurry 238 flows within the transport tubes 214*a,b*, the gravel slurry 238 is able to flow into the first and second packing tubes 218*a,b*, respectively, which split off the transport tubes 214*a,b* at the flow junctions 220*a,b*. The gravel slurry 238 may then be discharged from the first and second packing tubes 218*a,b* and into the annulus 118 via the orifices 222. Alternatively, or in addition thereto, the gravel slurry 238 may also be discharged from the ends of the first and second packing tubes 218*a,b* and the end of the second transport tube 214*b*, each of which may be open to the annulus 118.

During the gravel packing operations, a fluid may be extracted from the gravel slurry 238 and drawn into the interior 236 of the base pipe 202 via the sand screens 206*a,b*, as indicated by the arrows 240. More particularly, the fluid 240 may separate from the gravel and other particulate matter of the gravel slurry 238 and flow through the sand screens 206*a,b* and into the flow annulus 226. The fluid 240 then flows axially within the flow annulus 226 until locating the perforations 234. With the production sleeve 130 in the open position (as shown in dashed lines), the perforations 234 may be exposed and able to convey the fluid 240 into the interior 236 for production to the surface.

Figure 3:
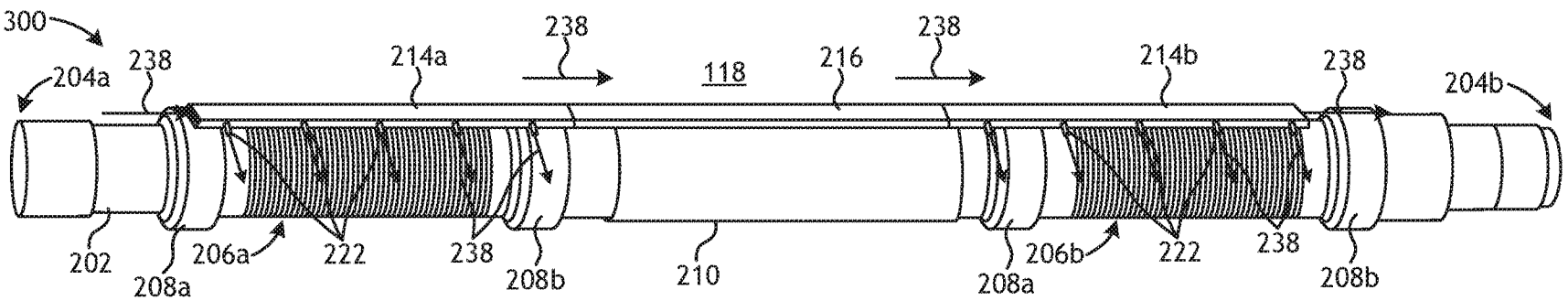
FIG. 3 depicts another exemplary completion section that can incorporate principles of the present disclosure.

FIG. 3 is an isometric view of another exemplary completion section 300, according to one or more embodiments of the present disclosure. The completion section 300 may be similar in some respects to the completion section 200 of FIGS. 2A-2C and therefore may be best understood with reference thereto, where like numerals refer to like elements not described again. As illustrated, the completion section 300 may include the base pipe 202, the first and second sand screens 206*a,b* arranged about the base pipe 202 and axially offset from each other, and a shunt system 302 used to ensure a complete sand face pack is achieved in the annulus 118 while gravel packing about the completion section 300.

Unlike the shunt system 212 of FIGS. 2A-2C, however, the shunt system 302 of FIG. 3 omits the packing tubes 218*a,b* (FIG. 2A). In the illustrated embodiment, the shunt system 302 is positioned exterior to the sand screens 206*a,b* and includes the first and second transport tubes 214*a,b* fluidly and operatively coupled by the jumper tube 216. In some embodiments, the shunt system 302 may include additional sets of transport tubes and interposing jumper tubes angularly offset from the first and second transport tubes 214*a,b* and the jumper tube 216. In such embodiments, the sets of transport tubes and interposing jumper tubes may be equidistantly or randomly positioned about the circumference of the base pipe 202.

In some embodiments, one or both of the first and second transport tubes 216*a,b* may include the one or more orifices 222 extending from a sidewall of the first and second transport tubes 214*a,b*. The orifices 222 may be configured to discharge the gravel slurry 238 from the transport tubes 214*a,b* into the surrounding annulus 118. In addition thereto, the gravel slurry 238 may also be discharged from the lower end of the second transport tube 214*b*, which may be open to the annulus 118.

In exemplary operation of the completion section 300, the gravel slurry 238 is introduced into the annulus 118 and may generally flow in the downhole direction (i.e., to the right in FIG. 3) within the annulus 118. In the event one or more sand bridges or the like form in the annulus 118, the shunt system 302 may be used to bypass the sand bridges and redirect the gravel slurry 238 to the remaining un-filled portions of the annulus 118. More particularly, the first transport tube 214*a* may receive a portion of the gravel slurry 238 at its open uphold end and convey the gravel slurry 238 to the second transport tube 214*b* via the jumper tube 216. The gravel slurry 238 flowing within the transport tubes 214*a,b* may be discharged into the annulus 118 via the orifices 222, or alternatively, or in addition thereto, from the end of the second transport tube 214*b*.

Figure 4A:
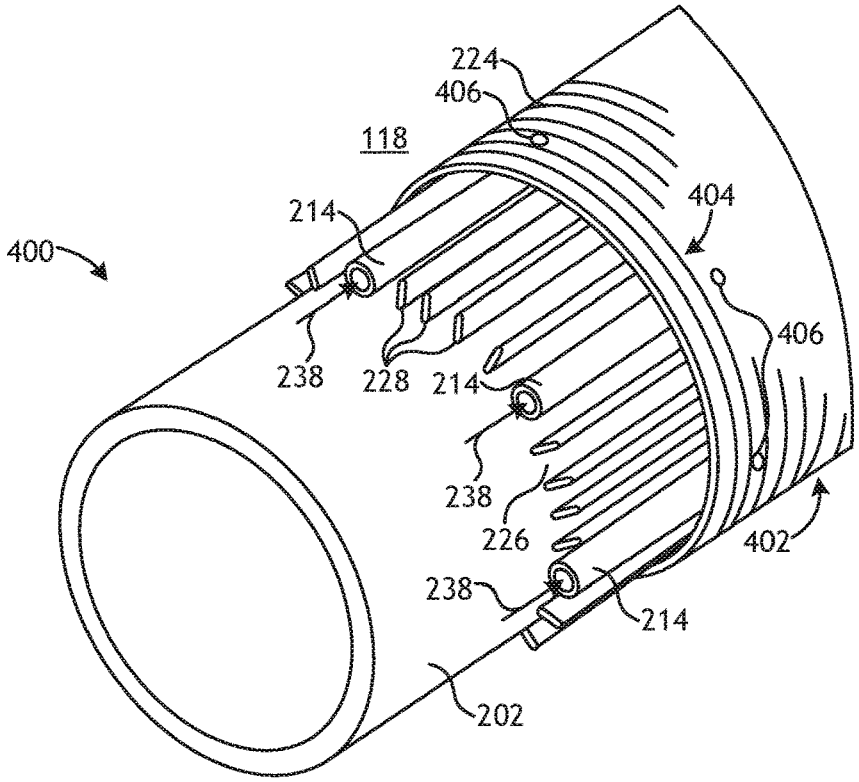
FIG. 4A is a partial, exposed isometric view of another exemplary completion section that can incorporate principles of the present disclosure.
Figure 4B:
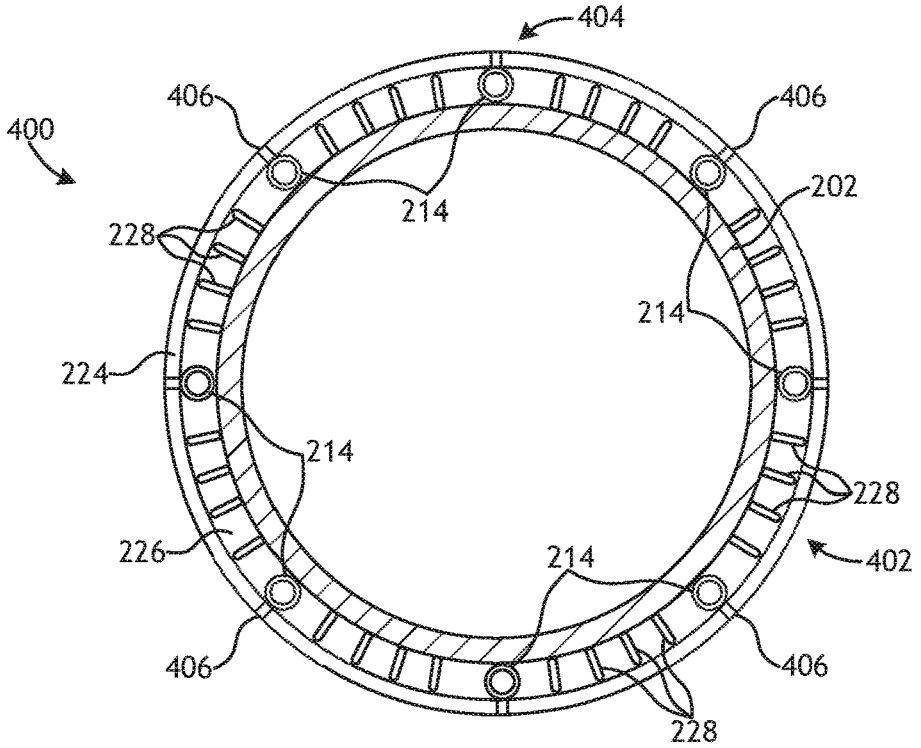
FIG. 4B is a cross-sectional end view of the completion section of FIG. 4A.

FIGS. 4A and 4B depict views of another exemplary completion section 400, according to one or more embodiments of the present disclosure. More particularly, FIG. 4A is a partial, exposed isometric view of the completion section 400, and FIG. 4B is a cross-sectional end view of the completion section 400. The completion section 400 may be similar in some respects to the completion sections 200 and 300 of FIGS. 2A-2C and FIG. 3, respectively, and therefore may be best understood with reference thereto, where like numerals refer to like elements not described again. Moreover, as with the completion sections 200 and 300, the completion section 400 may be configured to be deployed in cased or open-hole sections of the wellbore 106 (FIG. 1).

As illustrated, the completion section 400 may include the base pipe 202 and a sand screen 402 is arranged about the base pipe 202. The sand screen 402 may include the wire 224 wrapped or meshed about the circumference of the base pipe 202 and, more particularly, wrapped about the ribs 228 extending longitudinally along the outer surface of the base pipe 202. As described above, the ribs 228 radially offset the wire 224 from the outer surface of the base pipe 202 such that the flow annulus 226 is formed therebetween.

The completion system 400 may also include a shunt system 404 used to ensure a complete sand face pack is achieved in the annulus 118 while gravel packing about the completion section 400. Unlike the shunt systems 212 and 300 of FIGS. 2A-2C and FIG. 3, however, the shunt system 404 may be embedded within the flow annulus 226 and otherwise interposing the base pipe 202 and the wire 224 of the sand screen 402. As illustrated, the shunt system 404 may include a plurality of transport tubes 214 angularly offset from each other about the circumference of the base pipe 202. In some embodiments, as illustrated, each of the transport tubes 214 may comprise generally circular tubes or conduits. In other embodiments, however, one or more of the transport tubes 214 may exhibit other cross-sectional shapes such as, but not limited to, oval or polygonal (e.g., rectangular, square, triangular, etc.).

While not shown in FIGS. 4A-4B, the transport tubes 214 may extend through the upper and lower end rings 208*a,b* (FIGS. 2A, 2C, and 3), thereby providing a fluid conduit that extends along the entire axial length of the sand screen 402. Moreover, in some embodiments, the sand screen 402 may be axially spaced from another sand screen (not shown) and a communication sleeve 210 (FIGS. 2A, 2C, and 3) may extend between the lower end ring 208*b* of the sand screen 402 and the upper end ring 208*a* of the additional sand screen, such as is described in the completion assemblies 200 and 300. In such embodiments, the transport tubes 214 may extend through the flow annulus 226 defined between the communication sleeve 210 and the base pipe 202 to facilitate fluid communication between the axially adjacent sand screens.

Each transport tube 214 may include one or more orifices 406 that extend radially through the wire 224 or wire mesh of the sand screen 402 and facilitate fluid communication between the transport tubes 214 and the surrounding annulus 118. The orifices 406 may allow a portion of the gravel slurry 238 to exit the corresponding transport tube 214 and traverse the sand screen 402 at select axial locations along the completion section 400. In some embodiments, sets of orifices 406 may be provided at select axial locations and defined in a flow ring or manifold (not shown) provided in the sand screen 402 and extending about the circumference of the base pipe 202. In such embodiments, the transport tubes 214 may each be fluidly coupled to the flow manifold to allow a portion of the gravel slurry 238 to exit each transport tube 214 via the orifices 406 defined in the flow manifold. In other embodiments, or in addition thereto, the orifices 406 may instead be defined in the communication sleeve 210 (FIGS. 2A, 2C, and 3) and provide an exit for the gravel slurry 238 to exit the transport tubes 214 at the intersection between axially adjacent sand screens.

In exemplary operation of the completion section 400, the gravel slurry 238 is introduced into the annulus 118 and may generally flow in the downhole direction (i.e., to the right in FIG. 4) within the annulus 118. In the event one or more sand bridges or the like form in the annulus 118, the shunt system 402 may be used to bypass the sand bridges and redirect the gravel slurry 238 to the remaining un-filled portions of the annulus 118. More particularly, the upper ends of each transport tube 214 may extend through the upper end ring 208*a* (FIGS. 2A, 2C, and 3) or an upper entry sub (not shown) to be exposed to the annulus 118 and thereby receive a portion of the gravel slurry 238. The transport tubes 214 may then convey the gravel slurry 238 along its axial length until being discharged into the annulus 118 via the orifices 406.

Embodiments disclosed herein include:

A. A single trip multi-zone completion system that includes a plurality of completion sections operatively coupled together and extendable within a wellbore, each completion section including a base pipe providing an interior and defining one or more perforations at a single axial location to provide fluid communication between the interior and an annulus defined between the completion section and a wellbore wall, one or more sand screens radially offset from the base pipe such that a flow annulus is defined therebetween, and a production sleeve movably arranged within the interior of the base pipe between a closed position, where the production sleeve occludes the one or more perforations, and an open position, where the one or more perforations are exposed to allow fluid communication from the flow annulus into the interior. The single trip multi-zone completion system may further include a shunt system positioned about the base pipe of each completion section to receive and redirect a gravel slurry flowing in the annulus and thereby provide an alternate flow path for the gravel slurry.

B. A method may include positioning an outer completion string of a single trip multi-zone completion system in a wellbore, the outer completion string including a plurality of completion sections operatively coupled together and each completion section comprising a base pipe providing an interior and defining one or more perforations at a single axial location to provide fluid communication between the interior and an annulus defined between the completion section and a wellbore wall, one or more sand screens radially offset from the base pipe such that a flow annulus is defined therebetween, a production sleeve movably arranged within the interior of the base pipe between a closed position, where the production sleeve occludes the one or more perforations, and an open position, where the one or more perforations are exposed to allow fluid communication from the flow annulus into the interior, and a shunt system positioned about the base pipe. The method may further include advancing an inner service tool to a first completion section of the plurality of completion sections, injecting a gravel slurry into a first annulus defined about the first completion section with the inner service tool, receiving and redirecting a portion of the gravel slurry flowing in the first annulus with the shunt system of the first completion section, moving the inner service tool to a second completion section of the plurality of completion sections, injecting the gravel slurry into a second annulus defined about the second completion section with the inner service tool, and receiving and redirecting a portion of the gravel slurry flowing in the second annulus with the shunt system of the second completion section.

Each of embodiments A and B may have one or more of the following additional elements in any combination: Element 1: wherein the one or more sand screens include a first sand screen and a second sand screen axially offset from each other, the completion section further comprising a communication sleeve interposing the first and second sand screens. Element 2: wherein the shunt system is positioned on an exterior of the one or more sand screens and includes at least one transport tube that is open to the annulus at an upper end to receive the gravel slurry. Element 3: further comprising one or more orifices extending from a sidewall of the at least one transport tube for discharging the gravel slurry into the annulus. Element 4: wherein the shunt system further comprises a packing tube fluidly coupled to the at least one transport tube at a flow junction. Element 5: further comprising one or more orifices extending from a sidewall of the packing tube for discharging the gravel slurry into the annulus. Element 6: wherein the one or more sand screens include a first sand screen and a second sand screen axially offset from each other, and the at least one transport tube is a first transport tube extending along a portion of the first sand screen, the shunt system further comprising a second transport tube axially offset from the first transport tube and extending along a portion of the second sand screen, and a jumper tube that fluidly couples the first and second transport tubes. Element 7: further comprising one or more orifices extending from a sidewall of one or both of the first and second transport tubes for discharging the gravel slurry into the annulus. Element 8: further comprising a first packing tube coupled to the first transport tube at a first flow junction, a second packing tube coupled to the second transport tube at a second flow junction. Element 9: further comprising one or more orifices extending from a sidewall of one or both of the first and second packing tubes for discharging the gravel slurry into the annulus. Element 10: wherein the shunt system is positioned within the flow annulus and includes at least one transport tube that is open to the annulus at an upper end to receive the gravel slurry. Element 11: further comprising one or more orifices defined in the at least one transport tube and extending radially through the one or more sand screens for discharging the gravel slurry into the annulus. Element 12: wherein at least one of the completion sections is deployed in an open hole section of the wellbore. Element 13: wherein a string of casing is secured within the wellbore, and at least one of the completion sections is deployed in the wellbore adjacent the casing.

Element 14: wherein the shunt system is positioned on an exterior of the one or more sand screens and includes at least one transport tube that is open to the annulus at an upper end, the method further comprising receiving the gravel slurry at the upper end of the at least one transport tube. Element 15: further comprising discharging the gravel slurry into at least one of the first and second annuli via one or more orifices extending from a sidewall of the at least one transport tube. Element 16: wherein the shunt system further comprises a packing tube fluidly coupled to the at least one transport tube at a flow junction, the method further comprising discharging the gravel slurry into at least one of the first and second annuli via one or more orifices extending from a sidewall of the packing tube. Element 17: wherein the shunt system is positioned within the flow annulus and includes at least one transport tube that is open to the annulus at an upper end, the method further comprising receiving the gravel slurry at the upper end of the at least one transport tube. Element 18: further comprising discharging the gravel slurry into at least one of the first and second annuli via one or more orifices defined in the at least one transport tube and extending radially through the one or more sand screens.

By way of non-limiting example, exemplary combinations applicable to A and B include: Element 2 with Element 3; Element 2 with Element 4; Element 4 with Element 5; Element 2 with Element 6; Element 6 with Element 7; Element 6 with Element 8; Element 8 with Element 9; Element 10 with Element 11; Element 14 with Element 15; Element 14 with Element 16; and Element 17 with Element 18.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A single trip multi-zone completion system, comprising:

a plurality of completion sections operatively coupled together and extendable within a wellbore, each completion section including:

a base pipe providing an interior and defining one or more perforations at a single axial location to provide fluid communication between the interior and an annulus defined between the completion section and a wellbore wall;

sand screens radially offset from the base pipe such that a flow annulus is defined between the sand screens and the base pipe, wherein the flow annulus is continuous between at least two sand screens of the sand screens;

a production sleeve movably arranged within the interior of the base pipe between a closed position, where the production sleeve occludes the one or more perforations, and an open position, where the one or more perforations are exposed to allow fluid communication from the flow annulus into the interior; and a shunt system positioned about the base pipe of each completion section to receive and redirect a gravel slurry flowing in the annulus and thereby provide an alternate flow path for the gravel slurry.

2. The system of claim 1, wherein the sand screens include a first sand screen and a second sand screen axially offset from each other, the completion section further comprising a communication sleeve interposing the first and second sand screens.

3. The system of claim 1, wherein the shunt system is positioned on an exterior of the sand screens and includes at least one transport tube that is open to the annulus at an upper end to receive the gravel slurry.

4. The system of claim 3, further comprising one or more orifices extending from a sidewall of the at least one transport tube for discharging the gravel slurry into the annulus.

5. The system of claim 3, wherein the shunt system further comprises a packing tube fluidly coupled to the at least one transport tube at a flow junction.

6. The system of claim 5, further comprising one or more orifices extending from a sidewall of the packing tube for discharging the gravel slurry into the annulus.

7. The system of claim 3, wherein the more sand screens include a first sand screen and a second sand screen axially offset from each other, and the at least one transport tube is a first transport tube extending along a portion of the first sand screen, the shunt system further comprising:

a second transport tube axially offset from the first transport tube and extending along a portion of the second sand screen; and a jumper tube that fluidly couples the first and second transport tubes.

8. The system of claim 7, further comprising one or more orifices extending from a sidewall of one or both of the first and second transport tubes for discharging the gravel slurry into the annulus.

9. The system of claim 7, further comprising:

a first packing tube coupled to the first transport tube at a first flow junction; and a second packing tube coupled to the second transport tube at a second flow junction.

10. The system of claim 9, further comprising one or more orifices extending from a sidewall of one or both of the first and second packing tubes for discharging the gravel slurry into the annulus.

11. The system of claim 1, wherein the shunt system is positioned within the flow annulus and includes at least one transport tube that is open to the annulus at an upper end to receive the gravel slurry.

12. The system of claim 11, further comprising one or more orifices defined in the at least one transport tube and extending radially through the sand screens for discharging the gravel slurry into the annulus.

13. The system of claim 1, wherein at least one of the completion sections is deployed in an open hole section of the wellbore.

14. The system of claim 1, wherein a string of casing is secured within the wellbore, and at least one of the completion sections is deployed in the wellbore adjacent the casing.

15. A method, comprising:

positioning an outer completion string of a single trip multi-zone completion system in a wellbore, the outer completion string including a plurality of completion sections operatively coupled together and each completion section comprising:

a base pipe providing an interior and defining one or more perforations at a single axial location to provide fluid communication between the interior and an annulus defined between the completion section and a wellbore wall;

sand screens radially offset from the base pipe such that a flow annulus is defined between the sand screens and the base pipe, wherein the flow annulus is continuous between at least two sand screens of the sand screens;

a production sleeve movably arranged within the interior of the base pipe between a closed position, where the production sleeve occludes the one or more perforations, and an open position, where the one or more perforations are exposed to allow fluid communication from the flow annulus into the interior;

a shunt system positioned about the base pipe;

advancing an inner service tool to a first completion section of the plurality of completion sections;

injecting a gravel slurry into a first annulus defined about the first completion section with the inner service tool;

receiving and redirecting a portion of the gravel slurry flowing in the first annulus with the shunt system of the first completion section;

moving the inner service tool to a second completion section of the plurality of completion sections;

injecting the gravel slurry into a second annulus defined about the second completion section with the inner service tool; and receiving and redirecting a portion of the gravel slurry flowing in the second annulus with the shunt system of the second completion section.

16. The method of claim 15, wherein the shunt system is positioned on an exterior of the sand screens and includes at least one transport tube that is open to the annulus at an upper end, the method further comprising receiving the gravel slurry at the upper end of the at least one transport tube.

17. The method of claim 16, further comprising discharging the gravel slurry into at least one of the first and second annuli via one or more orifices extending from a sidewall of the at least one transport tube.

18. The method of claim 16, wherein the shunt system further comprises a packing tube fluidly coupled to the at least one transport tube at a flow junction, the method further comprising discharging the gravel slurry into at least one of the first and second annuli via one or more orifices extending from a sidewall of the packing tube.

19. The method of claim 15, wherein the shunt system is positioned within the flow annulus and includes at least one transport tube that is open to the annulus at an upper end, the method further comprising receiving the gravel slurry at the upper end of the at least one transport tube.

20. The method of claim 19, further comprising discharging the gravel slurry into at least one of the first and second annuli via one or more orifices defined in the at least one transport tube and extending radially through the sand screens.

* * * * *